US012628940B2

(12) United States Patent
Webb

(10) Patent No.: US 12,628,940 B2
(45) Date of Patent: May 19, 2026

(54) PLATFORM ASSEMBLY WITH ROTATABLE SEATING ASSEMBLIES HAVING ADJUSTABLE SUPPORT PLATFORMS

(71) Applicant: Alexis Webb, Cumming, GA (US)

(72) Inventor: Alexis Webb, Cumming, GA (US)

( * ) Notice: Subject to any disclaimer, the term of this patent is extended or adjusted under 35 U.S.C. 154(b) by 233 days.

(21) Appl. No.: 18/176,005

(22) Filed: Feb. 28, 2023

(65) Prior Publication Data

US 2024/0285067 A1 Aug. 29, 2024

(51) Int. Cl.
*A47B 3/14* (2006.01)
*A47D 1/00* (2006.01)
*A47D 1/02* (2006.01)

(52) U.S. Cl.
CPC ..... *A47B 3/14* (2013.01); *A47D 1/004* (2013.01); *A47D 1/023* (2017.05)

(58) Field of Classification Search
CPC ..... A47B 83/0213; A47B 83/021; A47B 3/14; A47D 1/004; A47D 1/023
USPC ..... 297/142, 411.31, 423.37, 242; 108/94, 108/103
See application file for complete search history.

(56) References Cited

U.S. PATENT DOCUMENTS 57,255 A * 8/1866 Marx ..... A47C 9/022 297/142
336,220 A * 2/1886 Farrar ..... A47C 1/08 297/344.21
1,384,695 A * 7/1921 Gilarski ..... A47B 83/02 297/142
1,898,307 A * 2/1933 Miller ..... A47B 3/14 297/142
3,276,431 A * 10/1966 Murcott ..... A61F 5/3784 297/465
4,385,414 A * 5/1983 Damico ..... A61G 7/0528 16/35 R
4,553,483 A * 11/1985 Votteler ..... A47B 17/02 108/4
5,191,676 A * 3/1993 Gerner ..... A47C 7/002 16/42 T
5,562,052 A * 10/1996 Glashouwer ..... A47B 9/14 108/1
7,862,409 B1 * 1/2011 Sheppard ..... A47B 9/04 452/198
2013/0069398 A1 3/2013 Chuah
2021/0059411 A1 3/2021 Samikkannu et al.

FOREIGN PATENT DOCUMENTS

GB 864895 A * 4/1961
KR 101925302 B1 12/2018

* cited by examiner

*Primary Examiner* — Milton Nelson, Jr.
(74) *Attorney, Agent, or Firm* — Ballard Spahr LLP

(57) ABSTRACT

A table and seating assembly may be used to provide a safe means for securing one or more children. The table and seating assembly may comprise a table assembly and one or more seating assemblies, wherein each seating assembly is coupled to a leg of the table assembly. A pivotable assembly may couple each seating assembly to the table assembly, wherein each pivotable assembly may enable each seating assembly to rotate between an open position and a closed position with respect to the table assembly.

20 Claims, 9 Drawing Sheets

PLATFORM ASSEMBLY WITH ROTATABLE SEATING ASSEMBLIES HAVING ADJUSTABLE SUPPORT PLATFORMS

BACKGROUND

Many children use tables that are typically equipped with attached seating for eating meals during break periods during school days. Conventional seating associated with these tables typically involve the use of a bench or stool seating combined into a single structure. However, these structures often have many disadvantages. For example, these tables may not provide quick and easy means for converting the structures between different configurations. Moreover, the bench or stool assemblies used for seating lack adequate safety means for securing the children while they are eating. Specifically, the bench and stool assemblies lack safety belts and anti-tip features to reduce the risk of children falling out of the seats. In addition, the bench and stool assemblies lack adequate back support and are rarely adjustable to accommodate the different heights of each child. Lastly, conventional table and seat structures are not easily accessible and are difficult to manage during lunch transition periods, increasing the risk for injury to the staff.

SUMMARY

Described herein, in various aspects, is a table and seating assembly for use in a room, such as a cafeteria, to provide a safe means to secure a child. The table and seating assembly may comprise a frame that is configured to secure a plurality of seating assemblies to the frame. A plurality of seating assemblies may be coupled to the frame. A pivotable assembly may be affixed to the frame and each seating assembly of the plurality of seating assemblies to secure the seating assembly to the table assembly. The pivotable assembly may be configured to rotate each seating assembly between a closed position inward to the table assembly and an open position away from the table assembly.

A method of using the bench assembly may comprise engaging the table and seating assembly, wherein the table and seating assembly may comprise a table assembly, a plurality of seating assemblies, and a plurality of pivotable assemblies. One or more of the seating assemblies may be rotated between a closed position inward to the table assembly and an open position away from the table assembly.

Additional advantages of the invention will be set forth in part in the description that follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION OF THE DRAWINGS

These and other features of the preferred embodiments of the invention will become more apparent in the detailed description in which reference is made to the appended drawings wherein.

DETAILED DESCRIPTION

Figure 1:
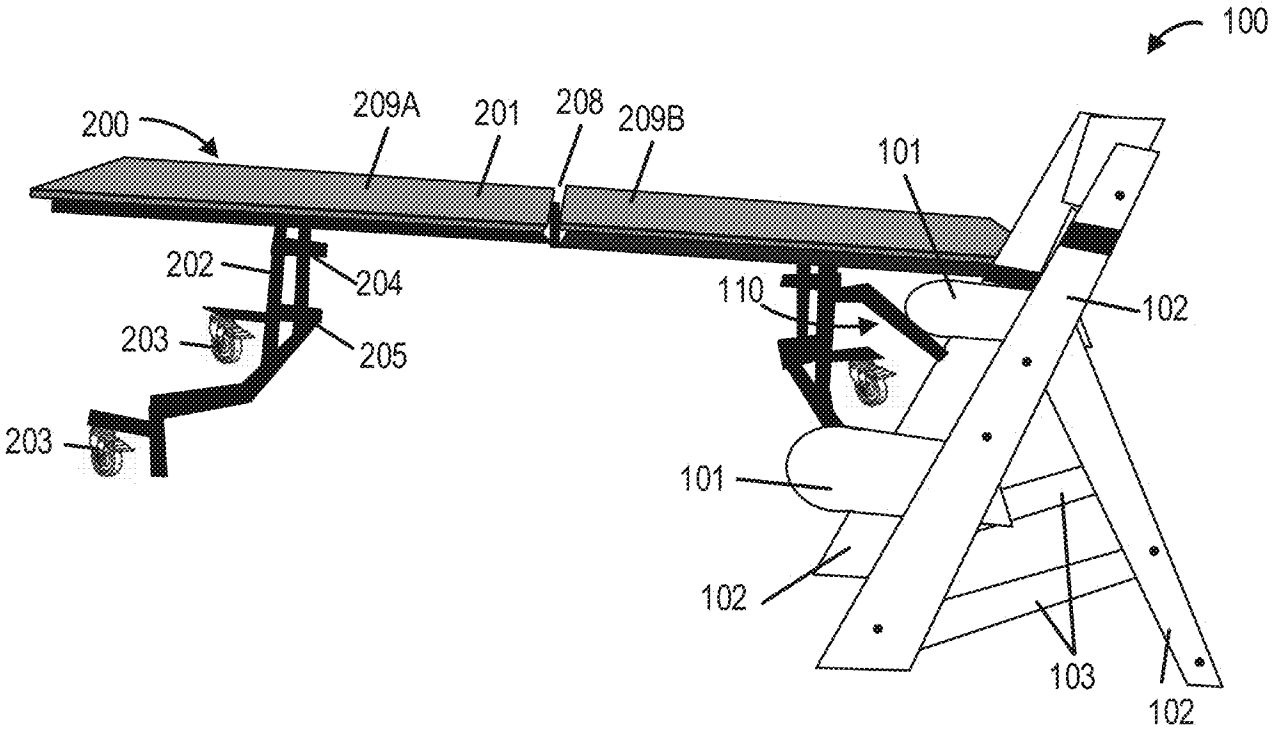
FIG. 1 is a side perspective view of a table and seating assembly, in accordance with embodiments disclosed herein, wherein the table and seating assembly has a pivotal assembly coupled to the table and seating assembly.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a," "an," and "the" include plural referents unless the context clearly dictates otherwise. For example, use of the term "a hinge" can refer to one or more of such hinges, and so forth.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

As used herein, the term "at least one of" is intended to be synonymous with "one or more of." For example, "at least one of A, B and C" explicitly includes only A, only B, only C, and combinations of each.

All technical and scientific terms used herein have the same meaning as commonly understood to one of ordinary skill in the art to which this invention belongs unless clearly indicated otherwise.

As used herein, the terms "optional" or "optionally" mean that the subsequently described event or circumstance may or may not occur, and that the description includes instances where said event or circumstance occurs and instances where it does not.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Optionally, in some aspects, when values are approximated by use of the antecedent "about," it is contemplated that values within up to 15%, up to 10%, up to 5%, or up to 1% (above or below) of the particularly stated value can be included within the scope of those aspects. Similarly, use of "substantially" (e.g., "substantially parallel") or "generally" (e.g., "generally planar") should be understood to include embodiments in which angles are within ten degrees, or within five degrees, or within one degree.

The word "or" as used herein means any one member of a particular list and also includes any combination of members of that list.

It is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

The following description supplies specific details in order to provide a thorough understanding. Nevertheless, the skilled artisan would understand that the apparatus, system, and associated methods of using the apparatus can be implemented and used without employing these specific details. Indeed, the apparatus, system, and associated methods can be placed into practice by modifying the illustrated apparatus, system, and associated methods and can be used in conjunction with any other apparatus and techniques conventionally used in the industry.

Disclosed herein, in various aspects and with reference to FIGS. 1-12B, a table and seating assembly 100/200 that is configured to include a plurality of seating assemblies 100 affixed to each leg 202 of a table assembly 200. The table and seating assembly 100/200 may be used to enable one or more individuals (users) to sit safely and securely in at least one of the plurality of seating assemblies 100 without difficulty and risk of falling out of the seating assembly. The table and seating assembly 100/200 may comprise a table assembly 200, a plurality of seating assemblies 100, and a plurality of pivotable assemblies, as shown in FIG. 3, for example.

The table assembly may 200 comprise a first frame 202, a platform affixed 201 to a top portion of the first frame 202, and a plurality of seating assemblies 100 coupled to the first frame 202. For example, the platform 201 may comprise a table top 201 affixed to a top portion of the one or more first legs. The platform 201 may be configured to collapse, or fold, along a hinge 208 located at the center of the platform 201 between a first half 209A of the platform and a second half 209B of the platform 201. In an example, as shown in FIG. 3, the hinge 208 may be located away from the center of the platform 201. The platform 201 may comprise one or more of a metal material, a wood material, or a synthetic material. The first frame 202 may comprise the one or more first legs. Each first leg of the one or more first legs, as shown in FIG. 3, for example, may extend a predetermined length from a bottom portion of the platform 201 vertically. Each first leg may be of equal length to each other. In an example, each first leg may be vertically adjustable, as shown in FIG. 3. For example, as shown in FIG. 3, each first leg may have an inner portion 202A and an outer portion 202B that are slidable relative to each other and lockable in different axial positions relative to each other via, for example, a fastener or detent. For example, the inner portion 202A may have one or more detents that engage through-holes along the length of the outer portion 202B to lock the inner portion with respect to the outer portion to provide a leg having a desired length.

Each seating assembly 100 of the plurality of seating assemblies 100 may be coupled to each first leg of the table assembly 200. The seating assemblies 100 may be movable relative to the first frame 202 between a retracted (e.g., closed) position, as shown in FIG. 2, for access beneath the table assembly and an extended (e.g., open) position, as shown in FIGS. 1 and 3.

Figure 2:
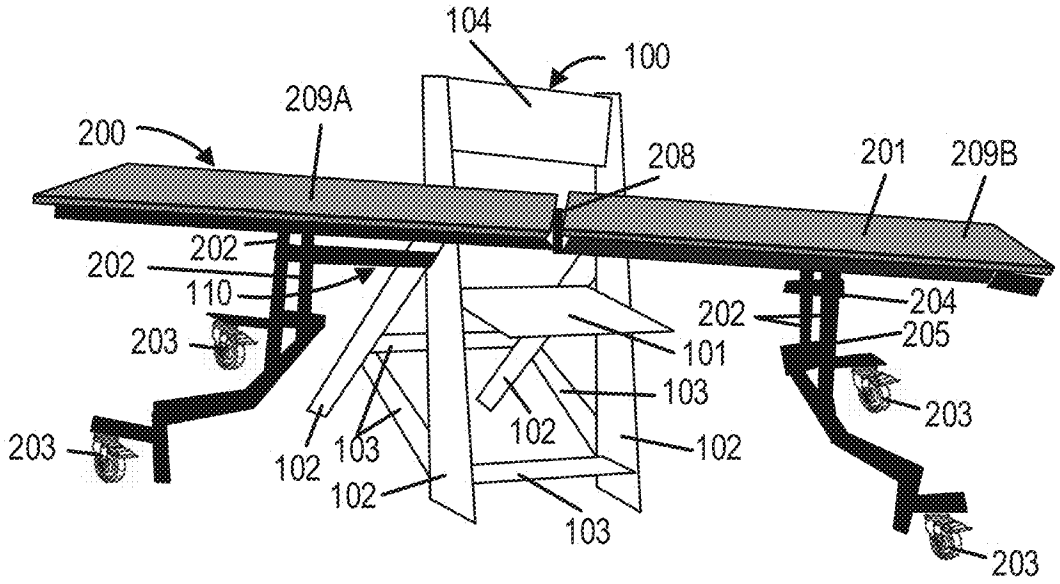
FIG. 2 is a side view of the table and seating assembly as in FIG. 1, wherein the seating assembly is rotated to a closed position.
Figure 3:
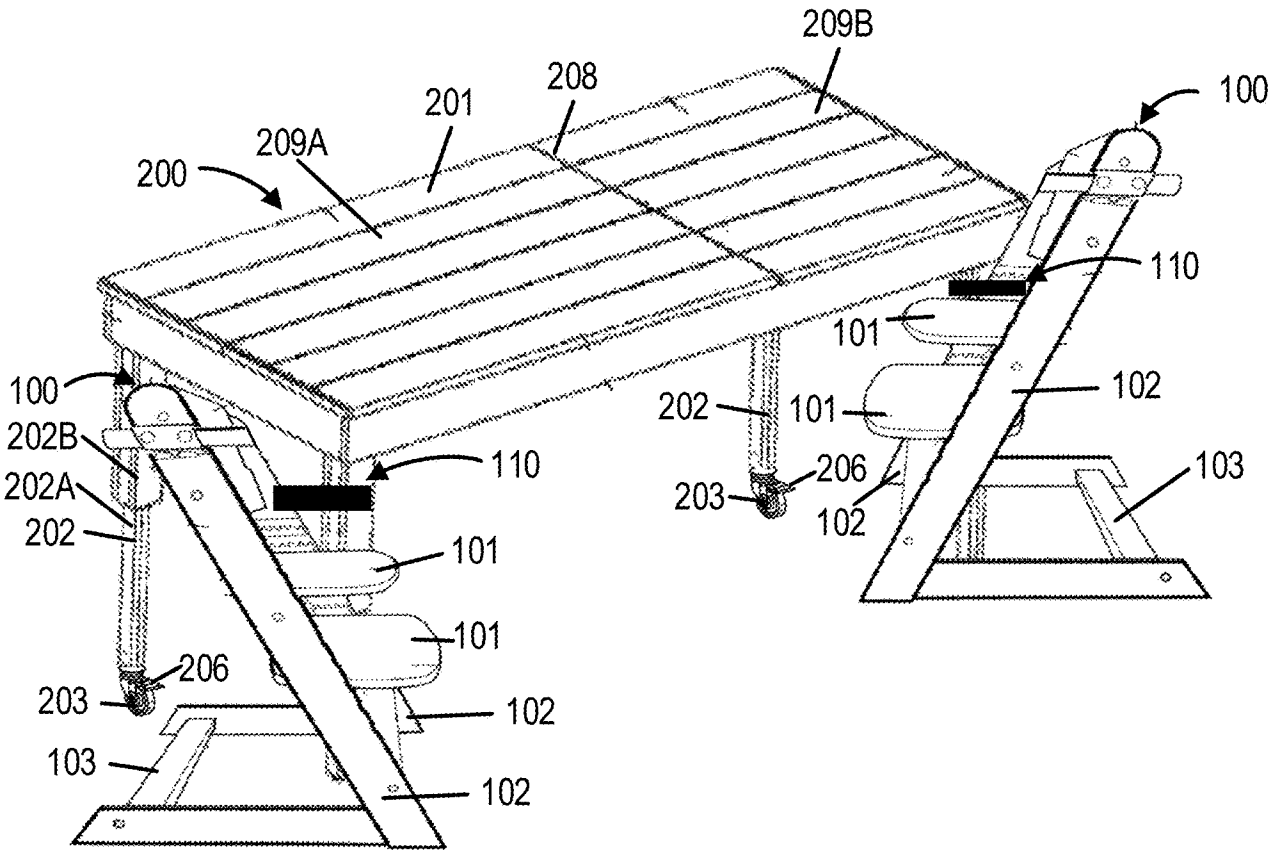
FIG. 3 is a top-side perspective view of the table and seating assembly as in FIG. 1, wherein the seating assembly is rotated to an open position.

As shown in FIG. 2, the first frame 202 may include one or more first legs, an upper cross-brace 204, and a lower cross-brace 205. The upper cross-brace 204 may be coupled between upper portions of the one or more legs for supporting the platform 201. The lower cross-brace 204 may be coupled between lower portions of the one or more legs and spaced apart from the upper cross-brace 204. As an example, the one or more legs may be arranged in a rectangular pattern. As an example, the one or more legs may be arranged in other polygonal or non-polygonal shapes. In an example, the platform 201 may comprise a circular shape, wherein the one or more legs may be arranged in a circular shape. In an example, a single leg may be affixed to a center portion of the platform 201. In an example, the plurality of seating assemblies 100 may be arrange along opposite sides of the table assembly 200. For example, one or more seating assemblies 100 may be arranged along a first side of the table assembly 200 while one or more seating assemblies 100 may be arranged along a side opposite of the first side of the table assembly 200. As a further example, the one or more legs may be arranged around the table assembly 200, wherein one or more seating assemblies 100 may be arranged along each side or in other patterns contemplated by the present disclosure.

Figure 4:
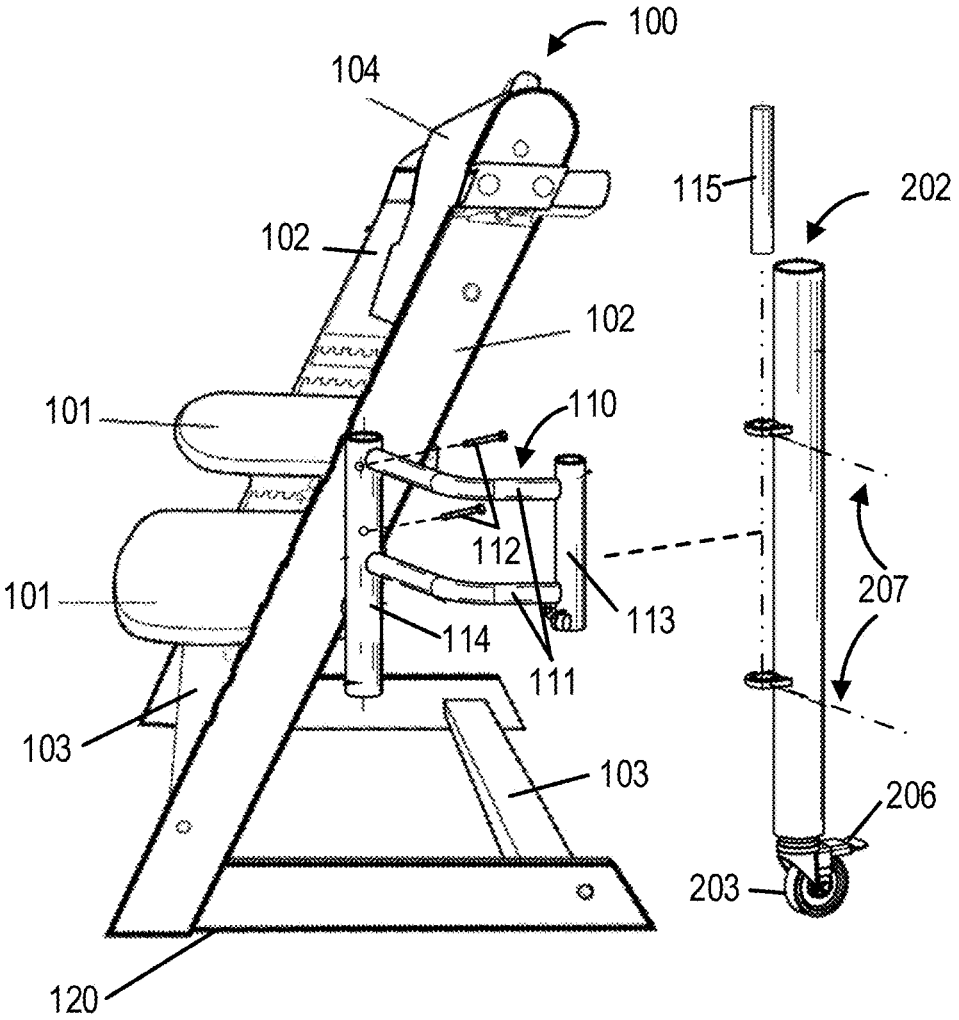
FIG. 4 is a side view of the seating assembly and the pivotable assembly of FIG. 1.

Each first leg of the one or more first legs may include a swivel wheel 203 affixed to a bottom portion of each first leg. The swivel wheel 203 of each first leg may comprise a release brake 206, as shown in FIGS. 3-4, that may be configured to lock the swivel wheel 203 in order to prevent the table assembly from moving. The release brake 206 may be released in order to allow the table assembly to be easily moved from one area to another area. In an example, non-slip feet may be affixed to the bottom portions of the one or more first legs instead of a swivel wheel 203. In an example, the non-slip feet and the swivel wheel 203 may be removably attached to the one or more first legs enabling the non-slip feet and the swivel wheel 203 to be freely switched depending on the intended use of the table assembly 100.

Each seating assembly 100 of the plurality of seating assemblies 100 may comprise a second frame 102, at least two support platforms 101 affixed to the second frame 102, and a pivotable assembly, as shown in FIGS. 1-4. Each second frame 102 of each seating assembly 100 may comprise one or more second legs 102. In an example, a plastic glider 120 may be affixed to a bottom portion of each second leg 102 of the one or more second legs 102. The plurality of pivotable assemblies may comprise a plurality of hinges 110. Each hinge 110 of the plurality of hinges 110 may be affixed to a first leg of the one or more first legs of the first frame 202 of the table assembly 200. Additionally, each hinge 110 may be affixed to a second leg 102 of the one or more second legs 102 of each second frame 102 of each seating assembly 100. Each hinge 110 may be configured to cause each seating assembly 100 to rotate, or pivot, around a leg of the table assembly 200. For example, the table assembly 200, seating assembly 100, and hinge 110 configuration may be configured such that each seating assembly 100 may be caused to rotate between at least one of the retracted/closed position, as shown in FIG. 1, or the extended/open position relative to the first frame, as shown in FIG. 2.

Each pivotable assembly of the plurality of pivotable assemblies may comprise a hinge 110. Each hinge 110 may be coupled to a first leg of the one or more first legs of the first frame 202 by a shaft 115, as shown in FIG. 4. Each hinge 110 may comprise a swing structure 114 coupled to a base structure 113 by one or more arms 111. The shaft 115 may extend through the base structure 113 to hold the hinge 110 on the first frame 202. The shaft 115 may extend through sockets 207 on the first frame 202 and fasteners, such as rivets, my extend through the sockets 207 into the shaft 113 to hold the shaft 113 on the first frame 202.

Each hinge 110 may comprise an arm 111 to couple the seating assembly 100 to the table assembly 200. A second leg 102 of the at least two second legs 102 of a seating assembly 100 may be affixed to the arm 111 of the hinge 110 via the swing structure 114. The arm 111 may extend from the base structure 113 to couple the second leg 102 of the seating assembly 100 to the hinge 110, and thus, coupling the seating assembly 100 to a first leg of the first frame 202 of the table assembly 200. The swing structure 114 may comprise a bracket 114 at one end that may be affixed to the second leg 102 of the seating assembly 100. One or more bolts 112 may be used to affix the bracket 114 to the second leg 102 of the seating assembly 100.

Each pivotable assembly may comprise a locking mechanism affixed to each hinge 110. In an example, each hinge 110 may include the locking mechanism. The locking mechanism may be configured to lock each seating assembly 100 in to at least one of an extended/open position or a retracted/closed position. Each pivotable assembly may comprise a latch affixed to each hinge 110 and each locking mechanism of each hinge 110. In an example, each hinge 110 may include the latch. The latch may be configured to release each locking mechanism to allow each seating assembly 100 to rotate to at least one of the extended/open position or the retracted/closed position. The retracted/closed position may comprise a seating assembly 100 of the plurality of seating assemblies 100 rotated inward to the table assembly 200, as shown in FIG. 2. The extended/open position may comprise a seating assembly 100 of the plurality of seating assemblies 100 rotated away from the table assembly 200, as shown in FIG. 1.

Figure 5:
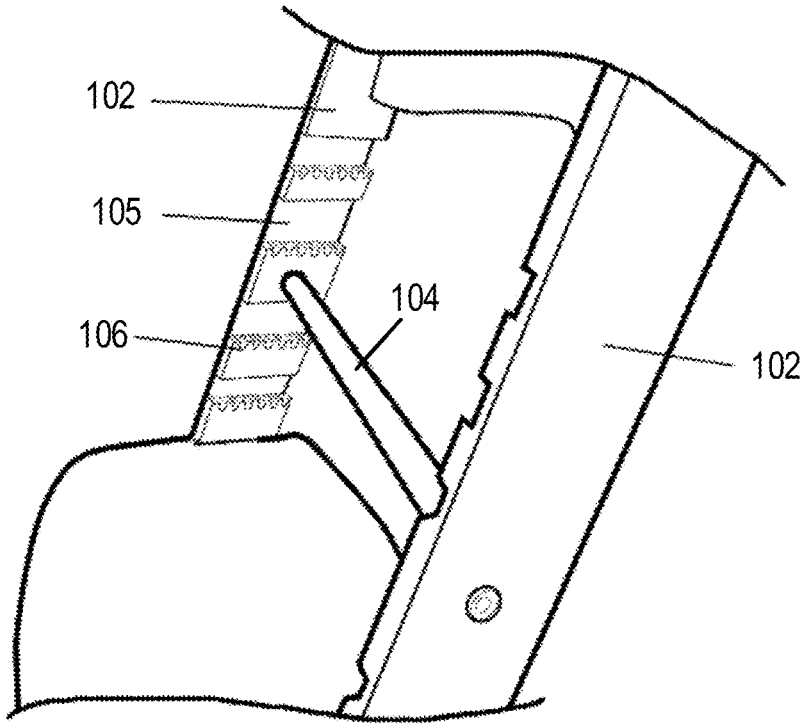
FIG. 5 is a view of a portion of the seating assembly as in FIG. 4.
Figures 12A, 12B:
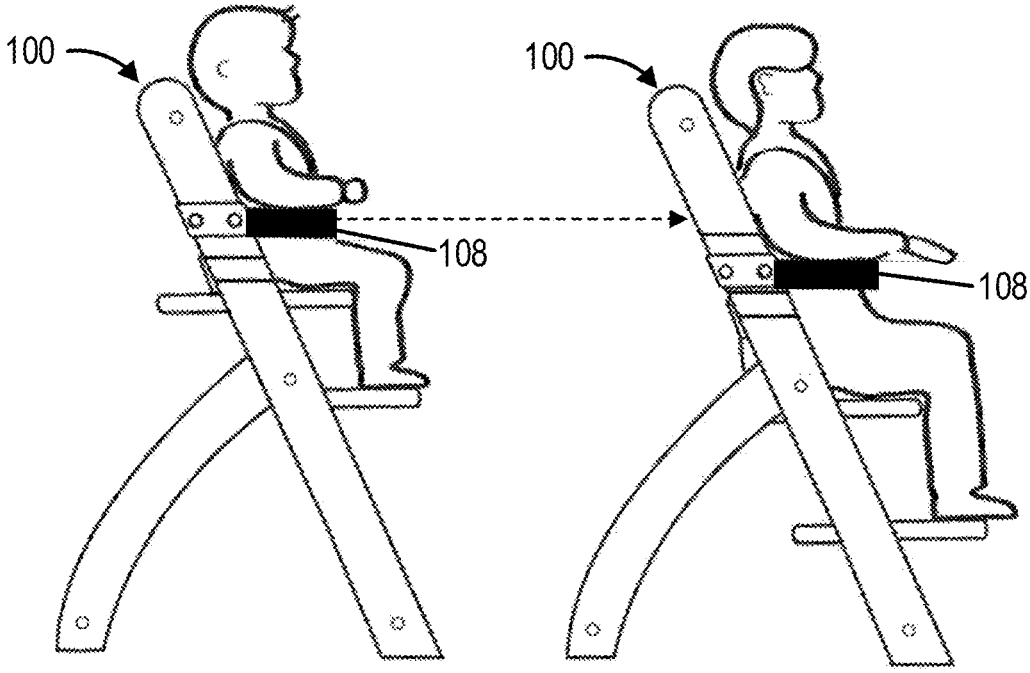
FIG. 12A is a side view of the seating assembly as in FIG. 4, wherein the support platforms are placed in a configuration to accommodate a smaller child.
FIG. 12B is a side view of the seating assembly as in FIG. 4, wherein the support platforms are placed in a configuration to accommodate a larger child.

Each seating assembly 100 of the plurality of seating assemblies 100 may comprise an adjustable chair. For example, each seating assembly 100 may comprise a safety belt 108, as shown in FIGS. 12A-12B, to safely secure an individual in the seating assembly 100. For example, each seating assembly 100 may comprise a backrest 104 affixed to a top portion of the at least two second legs 102 of each second frame 102, as shown in FIG. 4. In an example, the backrest 104 and the at least two second legs 102 may be configured such that that the backrest 104 may, optionally, be configured to be adjustable to various heights. In an example, a quick-disconnect clamp may enable decoupling and adjustment between the backrest 104 and the at least two second legs 102. For example, as shown in FIG. 5, each seating assembly 100 may comprise a metal rod 104 affixed to each of the at least two second legs 102.

Figure 6:
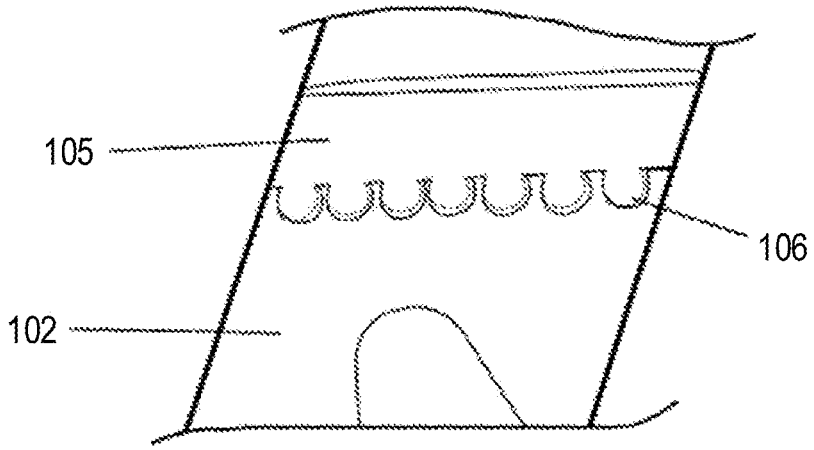
FIG. 6 is a view of a leg portion of the seating assembly as in FIG. 4.
Figure 7:
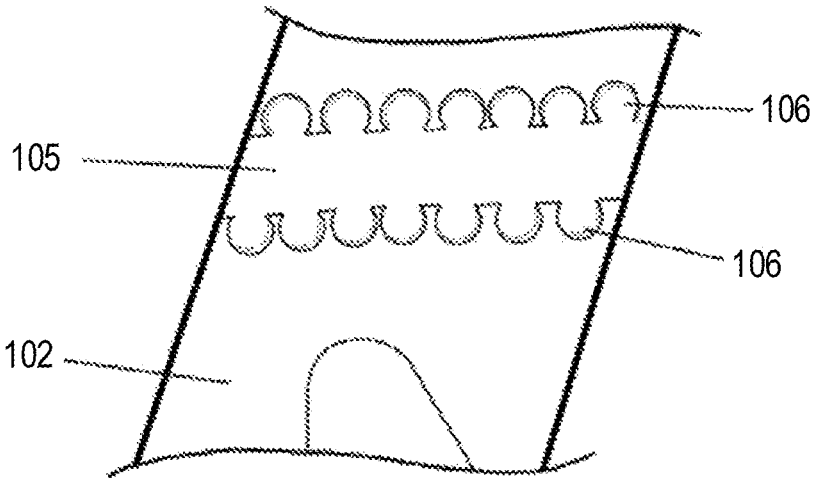
FIG. 7 is a view of a leg portion of the seating assembly as in FIG. 4.

Each second frame 102 of each seating assembly 100 may comprise a cross-brace 103 affixed to a bottom portion of the one or more second legs 102 of each frame 102. Each support platform 101 of the at least two support platforms 101 may be affixed to at least two second legs 102 of the one or more second legs 102 of each second frame 102, as shown in FIGS. 1-4. Each second leg 102 of the one or more second legs 102 of each second frame 102 may comprise a plurality of grooves 105, as shown in FIGS. 5-7. Each groove 105 of the plurality of grooves 105 may be located on an inner surface of each second leg 102. Each groove 105 may be positioned in a vertical manner from a bottom portion of each second leg 102 to a top portion of each second leg 102, as shown in FIG. 5.

Each support platform 101 of the at least two support platforms 101 of each second frame 102 may be configured to engage at least one groove 105 of the plurality of grooves 105 of each second leg 102 of the at least two second legs 102 of each second frame 102. In an example, one of the at least two support platforms 101 may be designed as a seat plate and another one of the at least two support platforms 101 may be designed as a foot plate, as shown in FIGS. 12A-12B. As an example, the seat plate may be padded. As an example, material of each support platform 101 may comprise a wood material or a synthetic material. The at least two support platforms 101 may be fastened onto the at least two second legs 102 by means of an interlocking system 105, 106, 107, 108, and 109. The interlocking system 105, 106, 107, 108, and 109 may comprise one or more holes 106 on the grooves 105 aligned on the inner surface of the second legs 102, as shown in FIGS. 5-7. The grooves 105 may be aligned vertically along the second legs 102 at a desired height span, equivalently on each facing sides of the second legs 102. In an example, the one or more holes 106 may be on the lower and upper lips of the groove 105, as shown in FIG. 7.

The one or more holes 106 allow the support platforms 101 to be locked at a variety of positions horizontally, wherein the support platform depth (e.g., height) may be adjusted to accommodate different sizes of an individual of the seating assembly. For example, FIG. 12A shows a first configuration to accommodate a small child. For example, FIG. 12B shows a second configuration to accommodate a larger child. As an example, a plurality of holes 106 may be used in order to add to the stability of the support platform 101. For example, as shown in FIGS. 5-9, the plurality of holes 106 increases the contact surface between the support platform 101 and the upright panel within the interlocking system 105, 106, 107, 108, and 109, and thus, minimizing the shakiness of the support platform 101. The plurality of holes 106 may be located on the upper and bottom lips of each groove 105, allowing the support platform 101 to be installed in a plurality of arrangements. For example, a support platform 101 of a smooth surface for seating may be flipped to reveal a bottom non-skid surface. The bottom non-skid surface may be used as a step ladder. For example, the support platform 101 may have a child passive restraint system on the front of the support platform 101 to prevent a user (e.g., a baby, or a child) from sliding out of the seating assembly 100. The support platform 101 may be inverted wherein the child passive restraint is at the back, and a smooth surface is at the front for adult seating.

As an example, the one or more holes 106 may be configured into various shapes and sizes to fit the accompanied interlocking system 105, 106, 107, 108, and 109 on the support platform 101. The one or more holes 106 may be configured into extension and indention (e.g., hills and valleys), holes for tabs, or holes with slots for anchoring hook locks.

Figure 10:
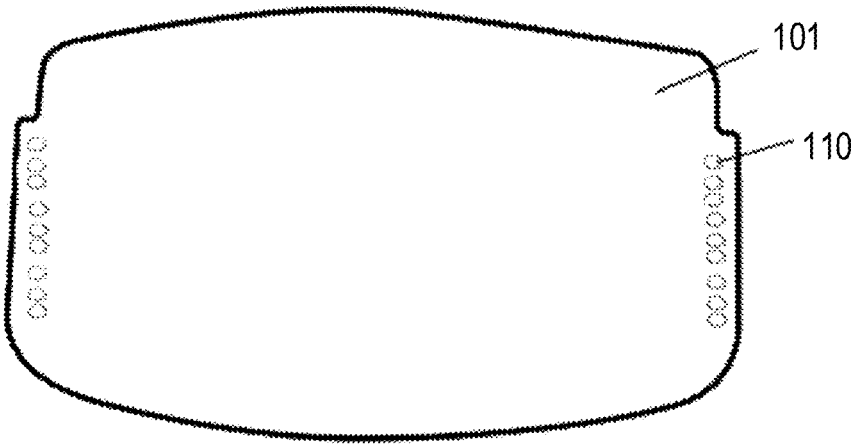
FIG. 10 is a view of a support platform of the seating assembly as in FIG. 4.
Figure 11:
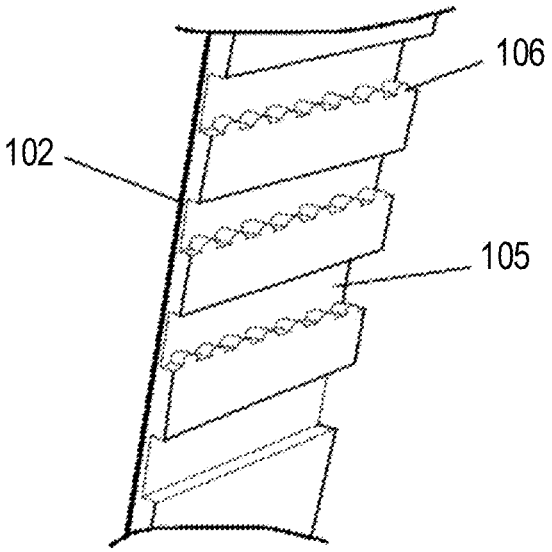
FIG. 11 is a view of a leg portion of the seating assembly as in FIG. 4.

The interlocking system 105, 106, 107, 108, and 109 of the support platform 101 may be configured, on each side, to include a complimentary strip of one or more tabs/holes 110, as shown in FIG. 10, wherein the one or more tabs/holes 110 may be designed to fit optimally onto the one or more holes 106 of the groove 105. In an example, the one or more tabs 110 may be comprise one or more hooks 110.

Figure 8:
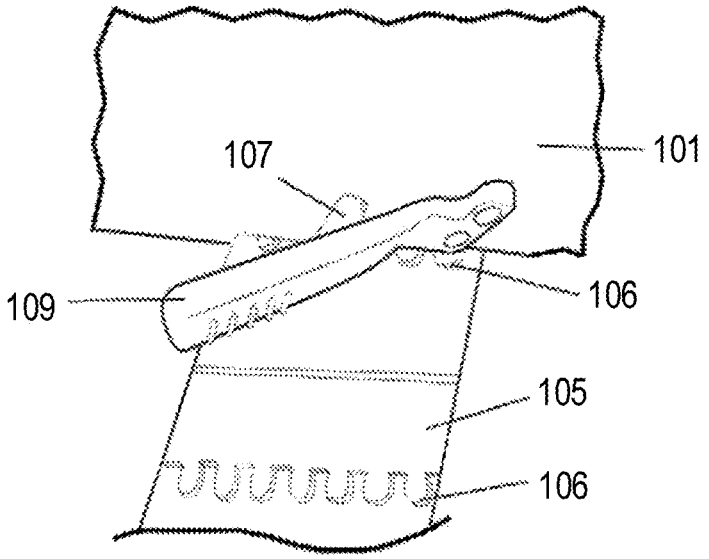
FIG. 8 is a view of a latch of the seating assembly as in FIG. 4.
Figure 9:
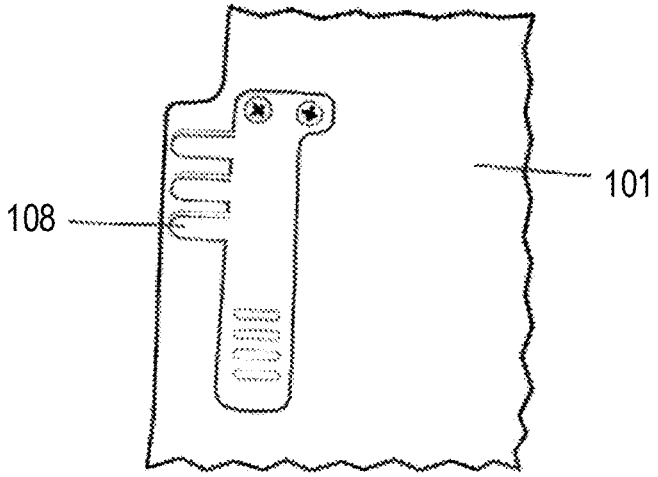
FIG. 9 is a view of a latch of the seating assembly as in FIG. 4.

Each support platform 101 may include a locking mechanism 107, 108, and 109. The lock may be engaged by the release of a tension created by a lever 109 that is attached to the one or more tabs 106 to form the locking mechanism, as shown in FIG. 8. The lever 109, when tension is applied, depresses the one or more tabs 106, allowing the support platform 101 to slide along the groove 105. When a desired placement is achieved, the lever 109 tension may be released to allow the one or more tabs 106 to lock onto the one or more tabs 110. As an example, the locking mechanism 107, 108, and 109 may be configured into various designs, sizes, and shapes to engage the one or more tabs 106 with the one or more tabs 110 on the vertical side of the groove 105. For example, the lever 109 may be replaced with a spring-operated push button.

In an example, the one or more tabs 106 may be disposed on a vertical aspect of the groove 105 of the second legs 102 of the seating assemblies 100. For example, the locking mechanism 107, 108, and 109 may be on the vertical sides of the support platform 101 to fit the vertical positon of the one or more tabs 106. The one or more tabs 106, now on the vertical sides of the support platform 101, will operate similar with tension created by depression of the lever 109 to slide a tab of the one or more tabs 106 to the lever 109 along the groove 105. When a desired position of the support platform 101 is achieved, the lever 109 may be released to allow the support platform 101 to lock into position. In an example, a hook may be used instead of the tab 106 of the one or more tabs 106. In an example, a plurality of tabs 110 may be used to fit a plurality of tabs 106 on the vertical side of the groove 105. In an example, the lever 109 may be replaced by a spring-operated push button.

While the present disclosure describes various exemplary embodiments, the disclosure is not so limited. To the contrary, the disclosure is intended to cover various modifications, uses, adaptations, and equivalent arrangements based on the principles disclosed. Further, this disclosure is intended to cover such departures from the present disclosure as come within at least the known or customary practice within the art to which it pertains. It is envisioned that those skilled in the art may devise various modifications and equivalent structures and functions without departing from the spirit and scope of the disclosure as recited in the following claims.

Although the foregoing invention has been described in some detail by way of illustration and example for purposes of clarity of understanding, certain changes and modifications may be practiced within the scope of the appended claims.

What is claimed is:

1. An apparatus comprising:

a platform assembly comprising a first frame and a platform affixed to a top portion of the first frame, wherein the first frame comprises one or more first legs;

a plurality of seating assemblies, wherein each seating assembly of the plurality of seating assemblies comprises at least two second legs and at least two support platforms affixed to an inner surface of each second leg of the at least two second legs, wherein each second leg of the at least two second legs of each seating assembly comprises a plurality of grooves on an inner surface of each second leg, wherein each groove of the plurality of grooves is positioned in a vertical manner from a bottom portion of each second leg to a top portion of each second leg; and a plurality of pivotable assemblies, wherein the plurality of pivotable assemblies comprises a plurality of hinges, wherein each hinge of the plurality of hinges is affixed to a surface of a first leg of the one or more first legs of the first frame and an outer surface of a second leg of the at least two second legs of each seating assembly, wherein each first leg of the platform assembly comprises an inner portion and an outer portion that are slidable relative to each other to adjust a length of each corresponding first leg and lockable in different axial positions to each other via a plurality of detents, and wherein each hinge is configured to cause each seating assembly to rotate to at least one of a closed position or an open position.

2. The apparatus of claim 1, wherein the platform assembly comprises a table.

3. The apparatus of claim 1, wherein the first frame further comprises a first cross-brace coupled to one or more upper portions of the one or more first legs and a second cross-brace coupled to one or more lower portions of the one or more first legs.

4. The apparatus of claim 3, wherein the first cross-brace is spaced apart from the second cross-brace.

5. The apparatus of claim 1, wherein each first leg of the one or more first legs comprise a swivel wheel affixed to a bottom portion of each first leg, wherein each swivel wheel of each first leg further comprises a release brake.

6. The apparatus of claim 1, wherein each seating assembly comprises an adjustable chair.

7. The apparatus of claim 6, wherein each support platform of each seating assembly comprises a safety belt.

8. The apparatus of claim 1, wherein each seating assembly further comprises a cross-brace coupled to the at least two second legs of each seating assembly.

9. The apparatus of claim 1, wherein each second leg of the at least two second legs of each seating assembly comprises a plastic glider affixed to a bottom portion of each second leg.

10. The apparatus of claim 1, wherein a first support platform of the at least two support platforms of each seating assembly comprises a seat plate.

11. The apparatus of claim 10, wherein a second support platform of the at least two support platforms of each seating assembly comprises a foot plate.

12. The apparatus of claim 10, wherein each seating assembly further comprises a backrest affixed to a top portion of the at least two second legs of each seating assembly.

13. The apparatus of claim 1, wherein each support platform of the at least two support platforms of each seating assembly engages at least one groove of the plurality of grooves of each second leg of the at least two second legs of each seating assembly.

14. The apparatus of claim 13, wherein each support platform of the at least two support platforms of each seating assembly comprises a locking mechanism, wherein the locking mechanism is configured to engage the at least one groove to secure each support platform to the at least two second legs of each seating assembly.

15. The apparatus of claim 1, wherein each pivotable assembly further comprises a locking mechanism affixed to each hinge, wherein the locking mechanism is configured to lock each seating assembly in at least one of the open position or the closed position.

16. The apparatus of claim 15, wherein each pivotable assembly further comprises a latch affixed to each hinge and each locking mechanism of each hinge, wherein the latch is configured to release each locking mechanism to allow each seating assembly to rotate to at least one of the open position or the closed position.

17. The apparatus of claim 1, wherein the closed position comprises a seating assembly of the plurality of seating assemblies rotated inward to the platform.

18. The apparatus of claim 1, wherein the open position comprises a seating assembly of the plurality of seating assemblies rotated away from the platform into an open vertical configuration.

19. A method comprising:

engaging an apparatus comprising:

a platform assembly comprising a first frame and a platform affixed to a top portion of the first frame, wherein the first frame comprises one or more first legs;

a plurality of seating assemblies, wherein each seating assembly of the plurality of seating assemblies comprises at least two second legs and at least two support platforms affixed to an inner surface of each second leg of the at least two second legs, wherein each second leg of the at least two second legs of each seating assembly comprises a plurality of grooves on an inner surface of each second leg, wherein each groove of the plurality of grooves is positioned in a vertical manner from a bottom portion of each second leg to a top portion of each second leg; and a plurality of pivotable assemblies, wherein the plurality of pivotable assemblies comprises a plurality of hinges, wherein each hinge of the plurality of hinges is affixed to a surface of a first leg of the one or more first legs of the first frame and a second leg of the at least two second legs of each seating assembly, wherein each first leg of the platform assembly comprises an inner portion and an outer portion that are slidable relative to each other to adjust a length of each corresponding first leg and lockable in different axial positions to each other via a plurality of detents, and wherein each hinge is configured to cause each seating assembly to rotate to at least one of a closed position or an open position; and causing, via one or more hinges, of the plurality of hinges, one or more seating assemblies of the plurality of seating assemblies to rotate into at least one of the closed position or the open position, wherein the closed position comprises the one or more seating assemblies rotated inward to the platform, and wherein the open position comprises the one or more seating assemblies rotated away from the platform.

20. The method of claim 19, further comprising engaging one or more locking mechanisms of the one or more hinges to lock one or more seating assemblies of the plurality of seating assemblies in at least one of the closed position or the open position.

* * * * *